US010766649B2

(12) United States Patent
Kim

(10) Patent No.: US 10,766,649 B2
(45) Date of Patent: Sep. 8, 2020

(54) VACUUM DEVICE FOR BAG

(71) Applicant: ROLLPACK. CO., LTD., Gyeonggi-do (KR)

(72) Inventor: Kum-Ja Kim, Gyeonggi-do (KR)

(73) Assignee: ROLLPACK. CO., LTD., Gyeonggi-do (KR)

( * ) Notice: Subject to any disclaimer, the term of this patent is extended or adjusted under 35 U.S.C. 154(b) by 169 days.

(21) Appl. No.: 15/770,782

(22) PCT Filed: Oct. 26, 2016

(86) PCT No.: PCT/KR2016/012048

§ 371 (c)(1),
(2) Date: Apr. 25, 2018

(87) PCT Pub. No.: WO2017/073999

PCT Pub. Date: May 4, 2017

(65) Prior Publication Data

US 2018/0319524 A1 Nov. 8, 2018

(30) Foreign Application Priority Data

Oct. 26, 2015 (KR) ..... 10-2015-0148766

(51) Int. Cl.
*B65B 31/04* (2006.01)
*B65B 31/02* (2006.01)

(52) U.S. Cl.
CPC ..... *B65B 31/047* (2013.01); *B65B 31/02* (2013.01); *B65B 31/024* (2013.01)

(58) Field of Classification Search
None
See application file for complete search history.

(56) References Cited

U.S. PATENT DOCUMENTS 3,665,958 A * 5/1972 Dunkelis ..... F16K 17/00 137/522
7,805,913 B2 * 10/2010 Alipour ..... B29C 65/18 53/512
2006/0254219 A1 11/2006 Alipour et al.
2008/0028730 A1 2/2008 Savicki et al.
(Continued)

FOREIGN PATENT DOCUMENTS

DE 202008001785 6/2008
JP S54109848 8/1979
(Continued)

OTHER PUBLICATIONS

"Outdoor Vacuum Packaging Device Egg Keeping Flavor and Nutrition Fresh over Time," mls0k07 Blog, dated Mar. 19, 2013, 20 pages.

(Continued)

*Primary Examiner* — Daphne M Barry
(74) *Attorney, Agent, or Firm* — Dority & Manning, P.A.

(57) ABSTRACT

A vacuum device according to the present invention may comprise: a vacuum unit for suctioning air from inside a packaging back through a check valve of the packaging back, thereby generating a vacuum therein; and a clamping unit provided on the vacuum unit so as to clamp the packaging back such that the check valve of the packaging back airtightly communicates with an air suction portion of the vacuum unit.

5 Claims, 6 Drawing Sheets

(56) References Cited

U.S. PATENT DOCUMENTS

| | | | | |
|---|---|---|---|---|
| 2009/0165813 | A1 | 7/2009 | Sekine | |
| 2013/0101442 | A1 | 4/2013 | Ann | |
| 2013/0126526 | A1 | 5/2013 | So et al. | |
| 2015/0335192 | A1* | 11/2015 | Plazarte | B65B 25/22 99/332 |

FOREIGN PATENT DOCUMENTS

| | | |
|---|---|---|
| JP | 1998273114 | 10/2013 |
| KR | 20060091448 | 8/2006 |
| KR | 20110052286 | 5/2011 |
| KR | 20120038080 | 4/2012 |
| KR | 20120068456 | 6/2012 |
| KR | 1199894 | 11/2012 |
| KR | 20130010699 | 1/2013 |
| WO | WO2004065222 | 8/2004 |
| WO | WO2006130384 | 12/2006 |

OTHER PUBLICATIONS

International Search Report for PCT/KR2016/012048 dated Jan. 31, 2017, 4 pages.

* cited by examiner

[FIG. 1]
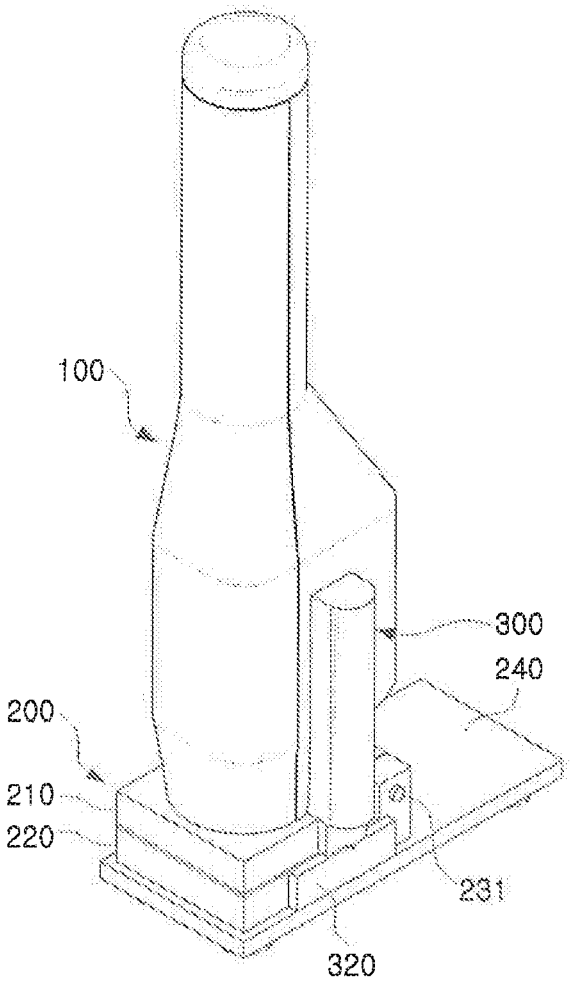

[FIG. 2]
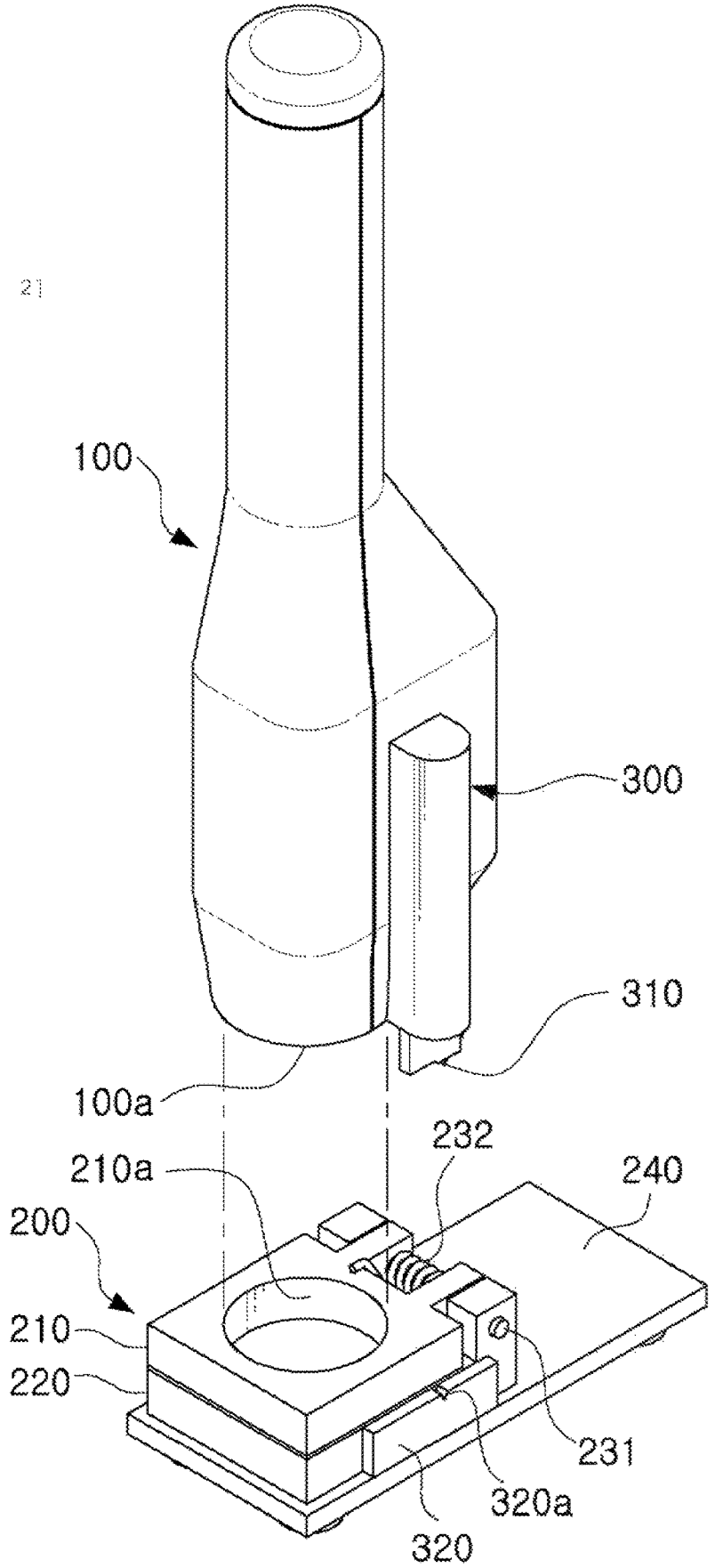

[FIG. 3]
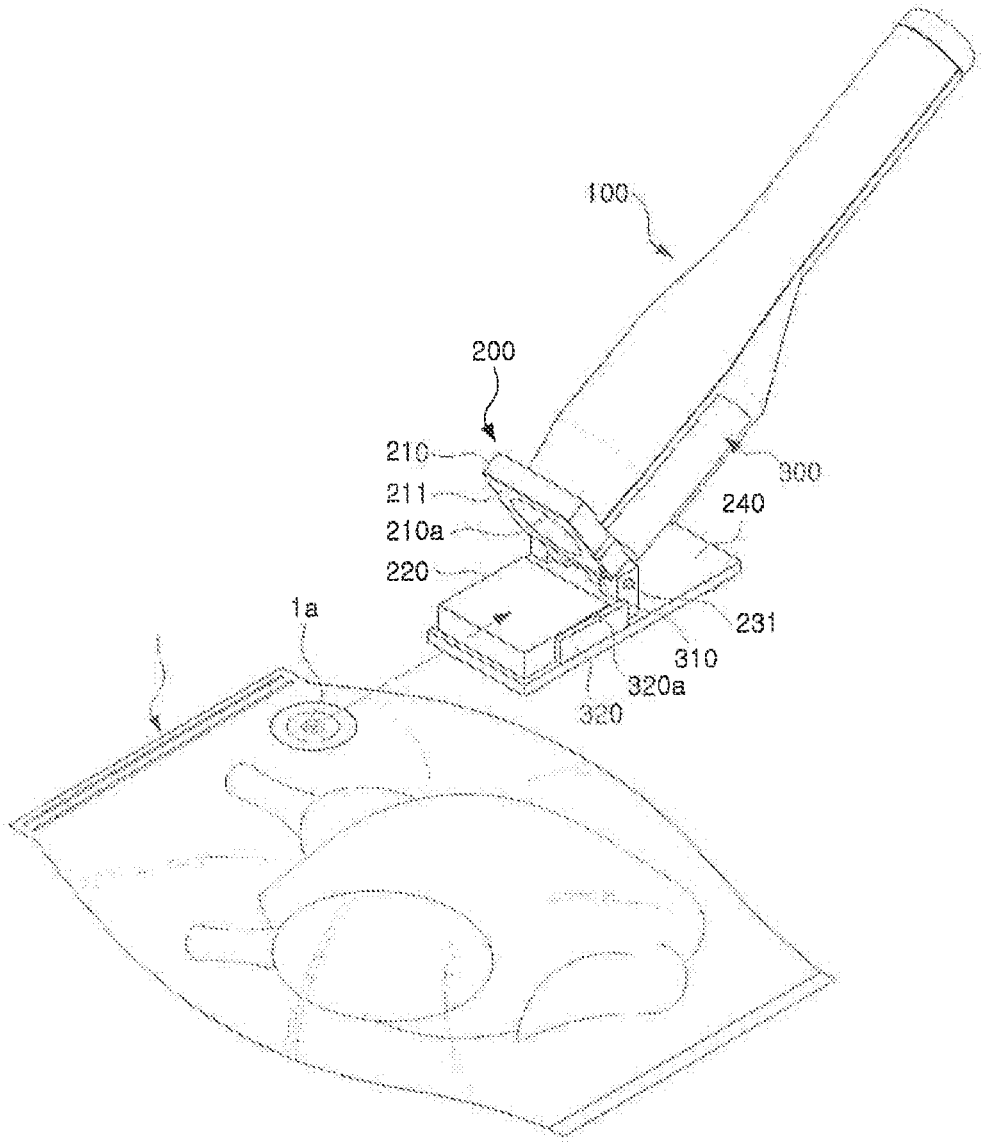

[FIG. 4]
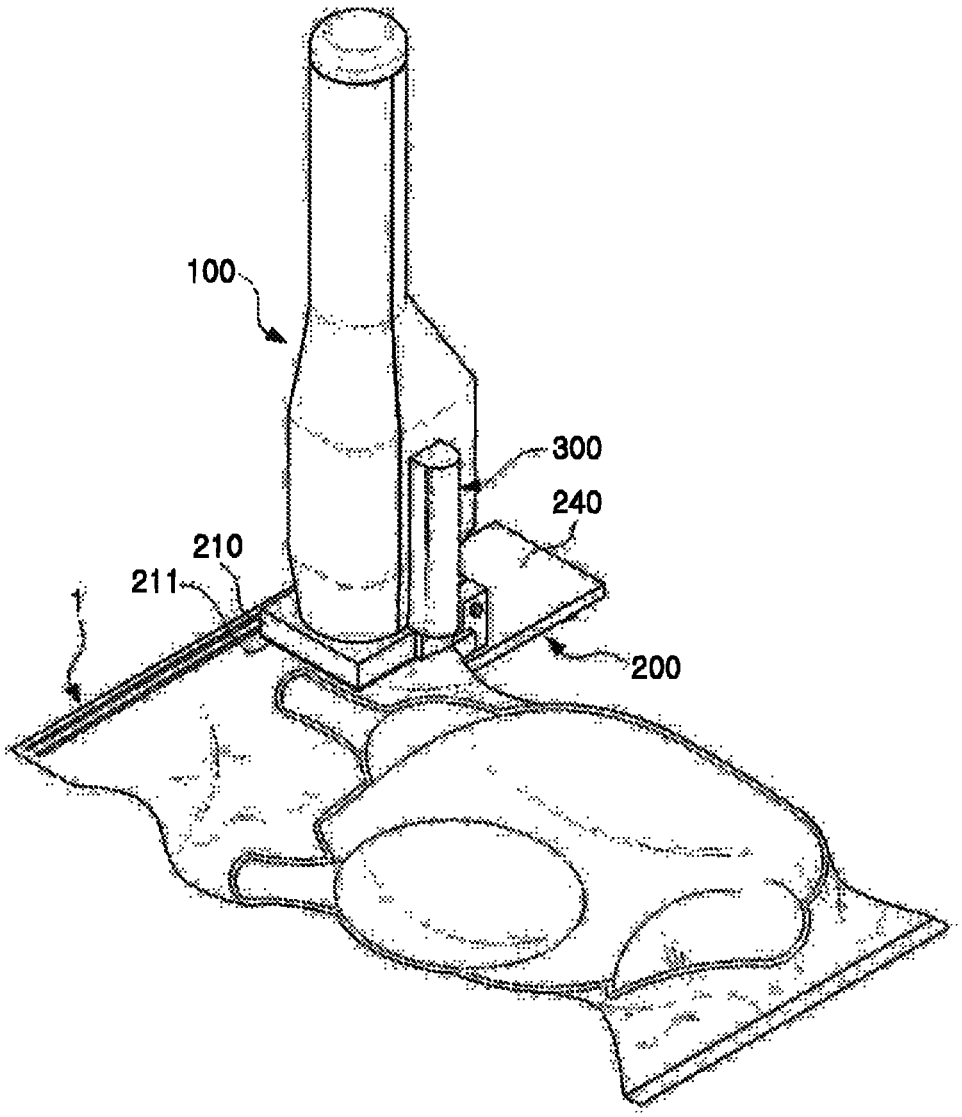

[FIG. 5]
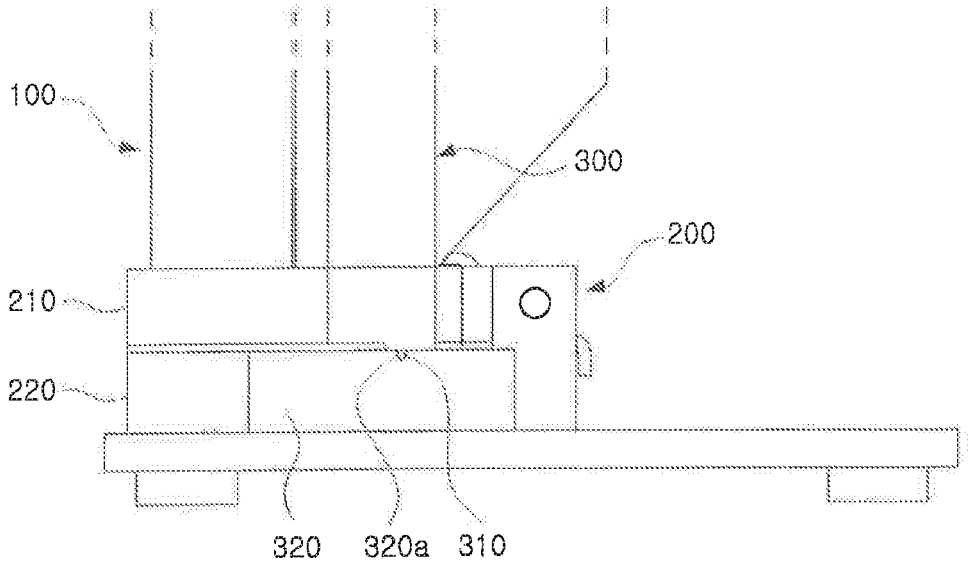

[FIG. 6]
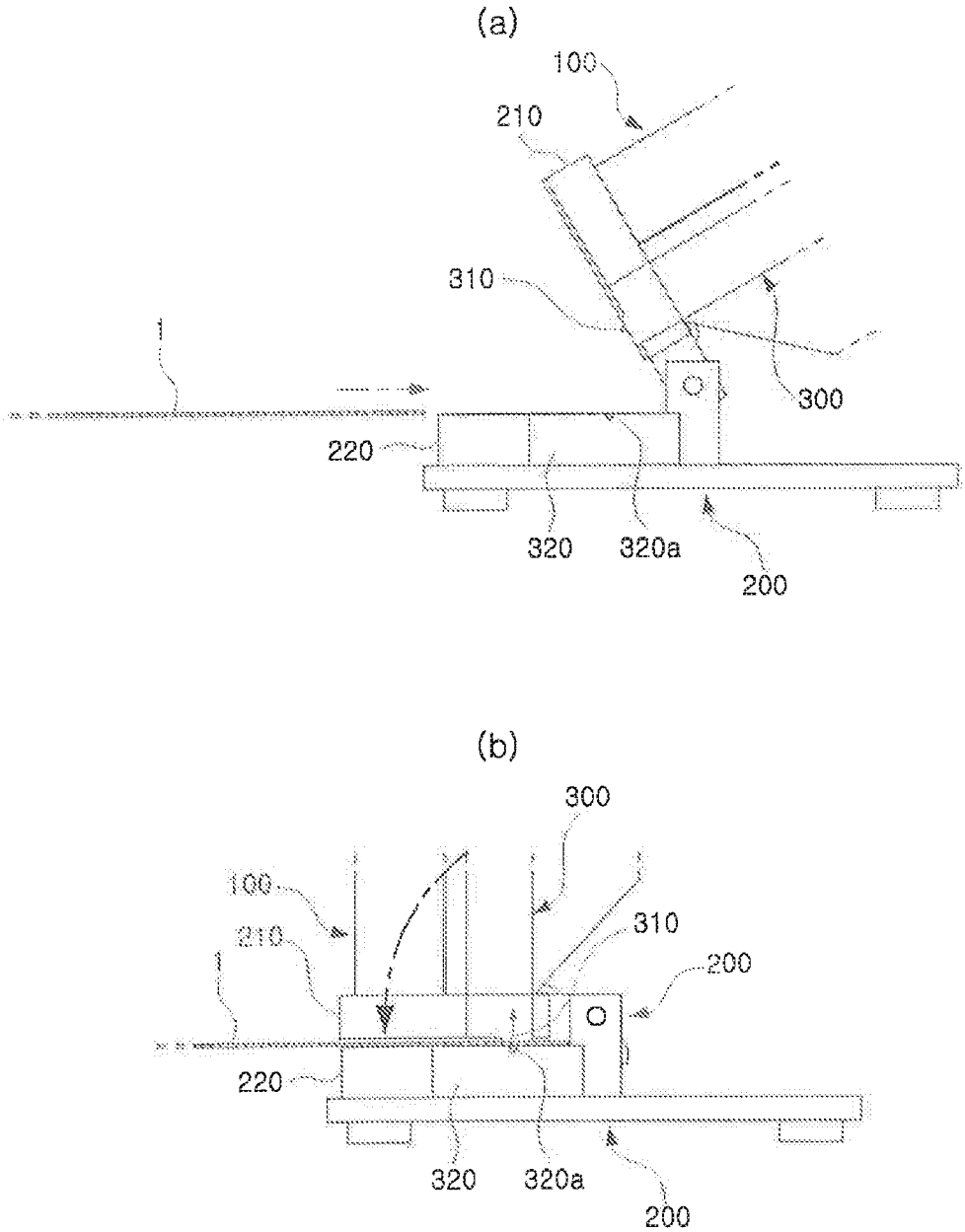

VACUUM DEVICE FOR BAG

TECHNICAL FIELD

The present disclosure relates to a vacuum device, and more particularly, to a vacuum device for evacuating a packing bag for vacuum packaging food or articles.

BACKGROUND ART

Vacuum devices for removing air from a packing bag to which food or articles are introduced, to reduce a volume of food or articles to pack the same in order to prevent oxidation and deterioration of food or cooked food and store the same for a long period of time have been developed and used.

For reference, a packing bag may have a check valve such as a vacuum valve of Korean Patent Application No. 2010-0057083, which is configured to allow air to be released externally from the packing bag and prevent an introduction of air, and such a packing bag may be a zipper bag having a zipper formed along the edge of one end as illustrated in FIGS. 3 and 4.

However, air suction may not be easily performed during a process of evacuating the inside of a packing bag by the vacuum device.

The reason is because, during the process of sucking air from inside the packing bag with the vacuum device, an air suction part of the vacuum device and the check valve of the packing bag are not in airtight communication with each other each other, forming a gap between the air suction part and the check valve to allow ambient air to be sacked into the vacuum device.

That is, in the process of bringing the check valve of the packing bag into contact with the air suction part of the vacuum device, the packing bag may not be in close contact with the air suction part, that is, the packing bag, while in a corrugated state, may be brought into contact with the air suction part, or while the packing bag may be in close contact with the air suction part, the corresponding state may not be continuously held during a vacuum suction process and a slightly separated state may occur, causing ambient air to be introduced to the inside of the packing bag through a gap not in close contact, and thus, the packing bag cannot be smoothly evacuated within a short time.

DISCLOSURE

Technical Problem

An aspect of the present disclosure provides a vacuum device capable of evacuating the inside of a packing bag smoothly within a short period of time.

Technical Solution

In an aspect of the present invention, a vacuum device may include: a vacuum unit sucking air from inside a packing bag through a check valve of the packing bag to evacuate the packing bag; and a clamping unit provided at the vacuum unit and clamping the packing bag such that the check valve of the packing bag airtightly communicates with an air suction part of the vacuum unit.

Here, the clamping unit may include: a first support plate having a connection hole to which the air suction part is connected; and a second support plate connected to be in close contact with the first support plate, wherein when the first support plate is moved to the second support plate to press the second support plate, the check valve of the packing bag positioned between the first support plate and the second support plate may airtightly communicate with the connection hole.

Here, the first support plate may be hinge-coupled to the second support plate.

Also, a torsion spring may be installed at a hinge shaft in a portion in which the first support plate and the second support plate are hinge-coupled, to elastically press the first support plate against the second support plate.

In addition, the clamping unit may further include a rest part extending from the hinge-coupled side at the second support plate or a rest plate installed on a side of the second support plate opposing the side to which the first support plate is coupled and having a size equal to or greater than the sum of the second support plate and the rest part, to prevent shaking when the first support plate rotates.

In addition, a friction pad may be mounted on at least one of corresponding surfaces of the first and second support plates.

Meanwhile, in the present disclosure, the vacuum device may further include: an operation unit installed on one side portion of the vacuum unit and electrically associated with the vacuum unit to sense clamping of the packing bag by the clamping unit to operate the vacuum unit.

Here, the operation unit may include a sensing unit sensing movement of the first support plate to the second support plate or sensing the packing bag disposed between the first support plate and the second support plate when the first support plate is moved to the second support plate to press the second support plate.

Here, the sensing unit may protrude and move upon being pushed by the packing bag disposed between the first support plate and the second support plate, when the first support plate is moved to the second support plate to press the second support plate.

In addition, a sensing releasing unit, which includes an operation releasing recess to which the sensing unit is inserted when the first support plate is moved to the second support plats to press the second support plate, when the packing bag is absent between the first support plate and the second support plate, may be installed on one side portion of the second support plate.

Advantageous Effects

The vacuum device according to the present disclosure includes the clamping unit clamping a packing bag such that the check valve of the packing bag tightly communicates with the air suction part of the vacuum unit. Since the check valve of the packing bag is in close contact with the air suction part of the vacuum device by the clamping unit and the close contact state is firmly maintained during an air suction process, the inside of the packing bag may be evacuated smoothly and quickly.

DESCRIPTION OF DRAWINGS

FIG. 1 is a perspective view illustrating a vacuum device according to an exemplary embodiment of the present disclosure.

FIG. 2 is a perspective view illustrating a state in which a vacuum unit is removed from a clamping unit in the vacuum device of FIG. 1.

FIGS. 3 and 4 are views illustrating a process of vacuum-packing a packing bag with the vacuum device of FIG. 1.

FIG. 5 is a side view of the vacuum device of FIG. 1.

FIG. 6 is a view illustrating a process of sensing, by a sensing unit of an operation unit, a packing bag clamping of the clamping unit in the vacuum device of FIG. 5.

BEST MODES

Hereinafter, exemplary embodiments of the present disclosure will be described in detail with reference to the accompanying drawings. In adding reference numerals for elements in each figure, it should be noted that like reference numerals already used to denote like elements in other figures are used for elements wherever possible. Moreover, detailed descriptions related to well-known functions or configurations will be ruled out in order not to unnecessarily obscure subject matters of the present disclosure.

FIG. 1 is a perspective view illustrating a vacuum device according to an exemplary embodiment of the present disclosure, FIG. 2 is a perspective view illustrating a state in which a vacuum unit is removed from a clamping unit in the vacuum device of FIG. 1, and FIGS. 3 and 4 are views illustrating a process of vacuum-packing a packing bag with the vacuum device of FIG. 1.

Referring to the drawings, the vacuum device of the present disclosure includes a vacuum unit 100 and a clamping unit 200.

Here, the vacuum unit 100 is a unit for sucking air from inside a packing bag 1 through a check valve 1*a* of the packing bag 1 to evacuate the packing bag 1. A specific component for evacuation is not limited by the present disclosure and the handy type unit as illustrated in the drawings may be utilized as an example.

Further, although not shown, a vacuum packaging device disclosed in Korean Patent Application No. 2013-0124623 may be utilized as the vacuum unit 100, and here, the vacuum device may be connected to a vacuum suction pipe (not shown) by the clamping unit 200.

The clamping unit 200 is provided in the vacuum unit 100 and clamps the packing bag 1 such that the check valve 1*a* of the packing bag 1 airtightly communicates with an air suction part 100*a* of the vacuum unit 100.

Specifically, the clamping unit 200 may include a first support plate 210 to which the air suction part 100*a* of the vacuum unit 100 is connected, and a second support plate 210 which is connected to the first support plate 210 and is in close contact with the second support plate 210.

Here, the first support plate 210 includes a connection hole 210*a* to which the air suction part 100*a* of the vacuum unit 100 is connected. The connection hole 210*a* of the first support plate 210 and the air suction part 100*a* of the vacuum unit 100 may be detached from each other.

Also, the second support plate 220 has a structure which is in close contact with the first support plate 210. When the first support plate 210 is moved and pressed to the second support plate 220, the check valve 1*a* of the packing bag 1 positioned between the support plate 210 and the second support plate 220 may airtightly communicate with the connection hole 210*a* of the first support plate 210.

Here, the connection structure in which the first support plate 210 and the second support plate 220 are in close contact with each other will be described with reference to the accompanying drawings by way of example. The first support 210 may be hinge-coupled to the second support plate 220. Accordingly, the first support plate 210 rotates about a hinge shaft 231 and rotates toward the second support plate 220 to be brought into close contact with a contact surface of the second support plate 220 when comes into contact with the second support plate 220.

Accordingly, as illustrated in FIGS. 3, 4 and 6, when the packing bag 1 is seated on the second support plate 220, the first support plate 210 rotates about the hinge shaft 231 toward the second support plate 220, whereby the packing bag 1 is tightly pressed between the first support plate 210 and the second support plate 220 by the first support plate 210 and the second support plate 220 and thus the check valve 1*a* of the packing bag 1 may airtightly communicate with the connection hole 210*a* of the first support plate 210.

In addition, a torsion spring 232 may be mounted in the hinge shaft 231 in a position in which the first support plate 210 and the second support plate 220 are hinge-coupled such that the first support plate 210 may be elastically pressed against the second support plate 220.

Here, the torsion spring 232 is hooked on an upper surface of the first support plate 210 and the other end thereof is hooked on an upper surface of the second support plate 220, whereby resilient returning force is increased when the first support plate 210 rotates in a direction away from the second support plate 220 so that the first support plate 210 is resiliently pressed against the second support plate 220.

In addition, a friction pad 211 may be mounted on at least one of the surfaces of the first and second support plates 210 and 220 corresponding to each other. Here, for example, the friction pad 211 is mounted only on the first support plate 210. The friction pad 211 allows the packing bag 1 positioned between the first support plate 210 and the second support plate 220 to be pressed by the first support plate 210 and the second support plate 220 so as to be more firmly clamped without sliding, when clamped.

The connection structure between the first support plate 210 and the second support plate 220 may be such that the first support plate 210 and the second support plate 220 are connected to each other so as to be in close contact with each other and is not limited by the present disclosure. For example, although not shown, the first support plate 210 and the second support plate 220 may be connected to each other by a screw shaft so that a distance between the first support plate 210 and the second support plate 220 may be reduced when the screw rotates.

Further, although not shown, in order to prevent shaking of the first support plate 210 when the first support plate 210 is rotated, the clamping unit 200 may include a rest part (not shown) extending from a hinge-coupled side at the second support plate 220.

In another example, in order to prevent shaking of the first support plate 210 when the first support plate 210 is rotated, the clamping unit may further include a rest plate 240 provided on the opposite side of the second support plate 220 to which the first support plate 210 is coupled, and having a size larger than the sum of the second support plate 220 and the rest part, as illustrated.

Accordingly, since the clamping unit, in a state of being seated in a portion having a predetermined surface like a bottom and stably supported by the rest part or the rest plate 240 described above in the seated portion, to prevent shaking when the first plate 210 rotates, thus having a stable operational structure.

FIG. 5 is a side view of the vacuum device of FIG. 1, and FIG. 6 is a view illustrating a process of sensing, by a sensing unit 310 of an operation unit 300, the packing bag 1 clamping of the clamping unit 200 in the vacuum device of FIG. 5.

Referring to FIGS. 3 to 6, the present disclosure may further include the operation unit 300 for operating the vacuum unit 100 when the packing bag 1 is clamped by the clamping unit 200.

The operation unit 300 may be installed on one side of the vacuum unit 100, may be electrically connected to the vacuum unit 100, and may operate the vacuum unit 100 by mechanically or electronically sensing that the packing bag 1 is clamped by the clamping unit 200.

More specifically, the operation unit 300 may include s sensing unit 310 sensing the packing bag 1 positioned between the first support plate 210 and the second support plate 220 when the first support plats 210 is moved to the second support plate 220 and pressed against the second support plate 220.

The sensing unit 310 is configured to mechanically or electronically detect clamping of the packing bag 1 by the clamping unit 200, and here, when an electronic sensing structure is used, various sensors may be utilized.

Also, when the sensing unit 310 has a mechanical sensing structure, for example, as illustrated, when the first support plate 210 is moved to the second support plate 220 to press the second support plate 220, the sensing unit 310 may be pushed by the packing bag 1 disposed between the first support plate 210 and the second support plate 220 so as to be moved. That is, the sensing unit 310 is a protruding operation switch which is pushed to an inner side of the operation unit 300 by the packing bag 1 when the sensing unit 310 is brought into contact with the packing bag 1 during a process of movement of the first support plate 210 toward the second support plate 220, thereby realizing control of the operation of the operation unit 300 with respect to the vacuum unit 100.

In addition, a sensing releasing unit 320 having an operation releasing recess 320*a* may be provided on one side of the second support plate 220.

Here, in case where the packing bag 1 is not present between the first support plate 210 and the second support plate 220, if the first support plate 210 is moved and pressed to the sensing unit 220, the sensing unit 310 is inserted into the operation releasing recess 320*a* of the sensing releasing unit 320, whereby the sensing unit 310 may not be pushed into the operation unit 300, and thus, the vacuum unit 100 does not operate.

The sensing releasing unit 320 may have a surface structure coplanar with a mounting surface of the second plate 220 on which the packing bag 1 is seated, in order to upwardly support the packing bag 1 at the same level as that of the second support plate 220 when the packing bag 1 is placed on the second support plate 220.

Meanwhile, the vacuum unit 100 of the present disclosure may be equipped with an operation switch (not shown) which may be separately pressed by the user so as to be operated, without the aforementioned operation unit 300. In addition, a separate operation switch (not shown) may also be installed together with the aforementioned operation unit 300, and in this case, when the operation switch is turned on, it may be operated, regardless of control of the operation unit 300.

As a result, as described above, in the present disclosure, since the clamping unit 200 clamping the packing bag 1 is configured such that the check valve 1*a* of the packing bag 1 airtightly communicates with the air suction part 100*a* of the vacuum unit 100, the check valve 1*a* of the packing bag 1 may be brought in close contact with the air suction part 100*a* of the vacuum device by the clamping unit 200 and the close contact state if firmly maintained during an air suction process, whereby the inside of the packing bag 1 may be evacuated smoothly and quickly.

While the present disclosure has been shown and described in connection with the exemplary embodiments, it will be apparent to those skilled in the art that modifications and variations may be made without departing from the spirit and scope of the invention as defined by the appended claims.

The invention claimed is:

1. A vacuum device comprising:

a vacuum unit sucking air from inside a packing bag through a check valve of the packing bag to evacuate the packing bag; and a clamping unit provided at the vacuum unit and clamping the packing bag such that the check valve of the packing bag airtightly communicates with an air suction part of the vacuum unit, wherein the clamping unit includes:

a first support plate having a connection hole to which the air suction part is connected; and a second support plate connected to be in close contact with the first support plate, wherein when the first support plate is moved to the second support plate to press the second support plate, the check valve of the packing bag positioned between the first support plate and the second support plate airtightly communicates with the connection hole, further comprising:

an operation unit installed on one side portion of the vacuum unit and electrically associated with the vacuum unit to sense clamping of the packing bag by the clamping unit to operate the vacuum unit, wherein the operation unit includes a sensing unit sensing movement of the first support plate to the second support plate or sensing the packing bag disposed between the first support plate and the second support plate when the first support plate is moved to the second support plate to press the second support plate, wherein the sensing unit protrudes and moves upon being pushed by the packing bag disposed between the first support plate and the second support plate, when the first support plate is moved to the second support plate to press the second support plate, wherein a sensing releasing unit, which includes an operation releasing recess to which the sensing unit is inserted when the first support plate is moved to the second support plate to press the second support plate, when the packing bag is absent between the first support plate and the second support plate, is installed on one side portion of the second support plate.

2. The vacuum device of claim 1, wherein the first support plate is hinge-coupled to the second support plate.

3. The vacuum device of claim 2, wherein a torsion spring is installed at a hinge shaft in a portion in which the first support plate and the second support plate are hinge-coupled, to elastically press the first support plate against the second support plate.

4. The vacuum device of claim 2, wherein the clamping unit further includes a rest part extending from the hinge-coupled side at the second support plate or a rest plate installed on a side of the second support plate opposing the side to which the first support plate is coupled, to prevent shaking when the first support plate rotates.

5. The vacuum device of claim 1, wherein a friction pad is mounted on at least one of corresponding surfaces of the first and second support plates.

* * * * *